US006443684B2

(12) United States Patent
Tucek

(10) Patent No.: US 6,443,684 B2
(45) **Date of Patent: *Sep. 3, 2002**

(54) GOLF BALL RETRIEVING ASSEMBLY

(76) Inventor: Milan Paul Tucek, 72 Old Cleveland Road, Capalaba, Queensland, 4157 (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/542,630

(22) Filed: Apr. 4, 2000

Related U.S. Application Data

(63) Continuation of application No. 09/000,379, filed as application No. PCT/AU96/00430 on Jul. 10, 1996, now Pat. No. 6,082,955.

(30) Foreign Application Priority Data

Aug. 7, 1995 (AU) ..... PN4607

(51) Int. Cl.[7] ..... B60P 1/00
(52) U.S. Cl. ..... 414/440
(58) Field of Search ..... 414/434, 435, 414/437, 439, 440; 294/19.2

(56) References Cited

U.S. PATENT DOCUMENTS

| | | | | | |
|---|---|---|---|---|---|
| 2,365,540 | A | * | 12/1944 | Fonken | 294/19.2 X |
| 2,605,005 | A | | 7/1952 | Wenzel et al. | |
| 2,735,562 | A | | 2/1956 | Kazanjian | |
| 3,175,714 | A | | 3/1965 | Witek | |
| 3,613,341 | A | | 10/1971 | Reeves | |
| 3,856,165 | A | | 12/1974 | Gustafson | |
| 3,995,759 | A | | 12/1976 | Hollrock et al. | |
| 4,761,026 | A | * | 8/1988 | Warden et al. | 294/19.2 |
| 4,792,271 | A | | 12/1988 | Akel | 414/440 |
| 5,087,165 | A | | 2/1992 | Akel | 414/440 |
| 5,141,383 | A | * | 8/1992 | Phillips et al. | 414/440 |
| 5,882,169 | A | * | 3/1999 | Tucek | 414/440 |

FOREIGN PATENT DOCUMENTS

| | | | | |
|---|---|---|---|---|
| FR | 2443851 | | 12/1978 | |
| GB | 1532208 | | 9/1977 | |
| GB | 2224942 | * | 5/1990 | 294/19.2 |
| WO | 8806910 | | 9/1988 | |

* cited by examiner

*Primary Examiner*—James W. Keenan
(74) *Attorney, Agent, or Firm*—Renner, Otto, Boisselle & Sklar, L.L.P.

(57) ABSTRACT

A golf ball retrieving apparatus (10) adapted to be pushed forward of a pushing vehicle (17). The apparatus (10) includes a plurality of golf ball collecting units (11–15) coupled to main frame assembly (16) and at least some of the golf ball collecting units (11–15) are able to swivel relative to the main frame assembly (16). Additionally, at least some of the golf ball collecting units (11–15) are able to move up and down relative to the main frame assembly (16).

2 Claims, 4 Drawing Sheets

GOLF BALL RETRIEVING ASSEMBLY

RELATED APPLICATIONS

This application is a continuation of U.S. patent application Ser. No. 09/000,379 filed on Jan. 29, 1998 (now U.S. Pat. No. 6,082,955 which is a 371 of PCT/AU96/00430 filed Jul. 10, 1996. The entire disclosure of this earlier application is hereby incorporated by reference.

FIELD OF THE INVENTION

This invention relates to a golf ball retrieving assembly which can be pushed over a fairway to collect golf balls therefrom.

BACKGROUND ART

To facilitate collection of a large number of golf balls from a fairway, it is known to use golf ball retrievers. One type of golf ball retriever uses a number of spaced discs mounted to a common shaft. The spacing between the discs corresponds to the width of a golf ball so that as the discs move over a ground surface, golf balls are caught between adjacent discs. The golf balls are subsequently dislodged by a dislodging finger and are transferred to a collecting basket. The discs can either be ground engaging or can be mounted to a common shaft which terminates with a pair of ground engaging wheels to space the discs slightly above the ground surface. Devices of this type are disclosed in the following U.S. patents: U.S. Pat. No. 3,995,759 (Hollrock), U.S. Pat. No. 3,823,838 (Gustafsson), U.S. Pat. No. 3,175,714 (Wittik), U.S. Pat. No. 2,792,955 (Summer), U.S. Pat. No. 2,365,540 (Fonken) and U.S. Pat. No. 4,792,271 (Akel).

Many known retrieving units suffer from the disadvantage that they are towed behind a tractor or like vehicle. The tractor can run over golf balls which makes them difficult or impossible to collect by the spaced discs. My earlier U.S. patent (Tucek U.S. Pat. No. 5,141,383) discloses such a towed vehicle, as does Woodall (U.S. Pat. No 2,812,871).

Golf ball retrieving assemblies which are pushed in front of a pushing vehicle such as a tractor or the like are also known. Gustafsson (U.S. Pat. Nos. 3,664,532 and 3,823,838) and also Hollrock (U.S. Pat. No. 3,995,759) disclose such pushed retrieving assemblies.

While pushed retrieving assemblies have the advantage that the pushing vehicle does not run over the golf balls before they are collected, existing assemblies still suffer from a number of disadvantages primarily the cost and complexity of the unit, and the inability of the retrievers to accurately track undulations along a fairway. In my earlier patent (Tucek U.S. Pat. No. 5,141,383) I provided an arrangement having wheels which individually tracked a ground surface. While the tracking was considered adequate, by having each wheel tracking a ground surface, the apparatus was relatively complex and expensive to manufacture.

Existing pushed retrievers usually comprise a single large unit or a number of smaller units linked together. The unit or units can be several metres long and each unit has a shaft to which the discs or wheels are mounted. By having a large single unit pushed in is front of a vehicle, or smaller units connected together, it is difficult to accurately track undulations along a fairway. That is, the single unit or linked units will merely pass over and not into gulleys, small depressions and the like. Examples of large single units or smaller interconnected units are described in Woodall (U.S. Pat. Nos. 2,812,871 and 3,784,037).

Another disadvantage with large or smaller linked units is in turning the entire assembly. When such an assembly is turned, the outer wheels turn more than the inner wheels and if the wheels are mounted to a common shaft, damage to the fairway will occur. Crabbing also occurs. Another disadvantage with existing golf ball retrieving assemblies is the use of angled draw bars which tend to cause a retrieving unit to adopt a sideways bias when being pushed or pulled along a fairway.

OBJECT OF THE INVENTION

The present invention has developed a golf ball retrieving apparatus which may overcome the abovementioned disadvantages or provide the public with a useful or commercial choice.

In one form, the invention resides in a golf ball retrieving apparatus adapted to be pushed forward of a pushing vehicle, the apparatus comprising a plurality of golf ball collecting units coupled to a main frame assembly, wherein at least some of the golf ball collecting units are able to swivel relative to the main frame assembly, and at least some of the golf ball collecting units are able to move up and down relative to the main frame assembly.

With this arrangement, the apparatus can have a number of golf ball collecting units attached thereto, the golf ball collecting units need not be linked directly together, and by being able to swivel and pivot, the apparatus can track undulations along a ground surface simply and effectively.

Suitably, a first golf ball collecting unit is coupled to a forward portion of the main frame assembly.

Suitably, a second golf ball collecting unit is coupled to one side of the main frame assembly and preferably forward of the pushing vehicle, and a third unit is coupled to the other side of the main frame assembly and preferably forward of the pushing vehicle.

Suitably, the second and third golf ball collecting units are swivably coupled to an arm member, the arm member being pivotally coupled to the main frame assembly to allow the second and third units to move up and down and also to swivel relative to the main frame assembly.

Suitably, a fourth golf ball collecting unit is attached to one side of the main frame assembly and also to one side and behind a forward portion of the pushing vehicle, and a fifth golf ball collecting unit is attached to the other side of the main frame assembly and again to one side and behind a forward portion of the pushing vehicle.

The main frame assembly may comprise a first frame member which can extend forwardly of the pushing vehicle. A second and third frame member may be attached to each side of the first frame member, and may extend rearwardly therefrom to adjacent each side of the pushing vehicle and behind a front portion of the pushing vehicle. The second and third frame members may be rigidly coupled to the first frame member.

The first golf ball collecting unit may be attached to a forward end of the first frame member and is suitably swivably attached thereto.

Suitably, the second and fourth golf ball collecting units are coupled to the second frame member and the third and fifth golf ball collecting units are coupled to the third frame member.

The second–fifth golf ball collecting units may be attached to respective arm members. The arm members may be pivotally coupled to the respective main frame assembly. The arm members may also be swivably attached to each respective golf ball collecting units to allow each unit to swivel about a vertical axis. Preferably, the second–fifth units are also pivotally coupled to their respective arm members to allow each unit to move up and down along a pivot axis which are generally in line with the forward movement of the golf ball retrieving apparatus.

BRIEF DESCRIPTION OF THE DRAWINGS

An embodiment of the invention will be illustrated with reference to the following drawings in which.

BEST MODE

Referring to the figures, there is shown a golf ball retrieving apparatus 10 which comprises first fifth collecting units 11–15 coupled to a main frame assembly 16. The golf ball retrieving apparatus 10 is pushed forwardly of a pushing vehicle 17 which can be of any type such as a tractor, buggy, truck and the like.

Figure 4:
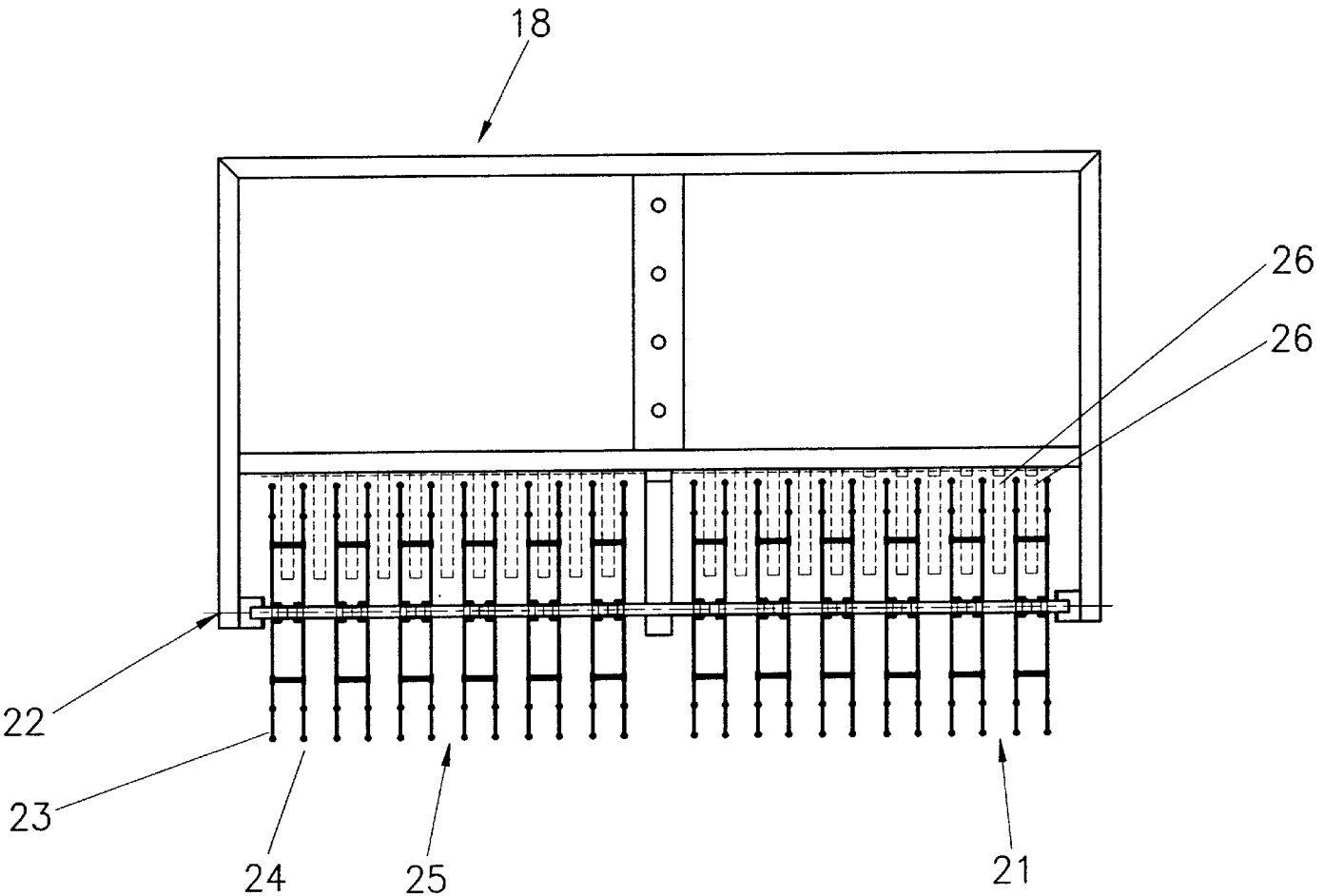
FIG. 4 is a plan view of a particular retrieving unit.

Each golf ball retrieving unit 11–15 is shown in greater detail with reference to FIG. 4 and shall be described in greater detail below.

Referring in greater detail to third retrieving unit 13, the unit has a rigid surround frame 18 made of metal section. In a forward portion of unit 13 are provided two collection baskets 19, 20 which can be formed from plastic coated wire mesh or like material and in which picked up golf balls are stored. The baskets can be made removable if desired. Behind baskets 19, 20 is a set of collection wheels or discs 21 which are mounted to a single common axle 22 which is better illustrated in FIG. 4. Wheels or discs 21 comprise pairs of spaced apart disc halves 23, 24 which are bolted together. The spacing between disc halves 23, 24 corresponds to the diameter of a golf ball such as a golf ball can be picked up between disc halves 23, 24. Referring again to FIG. 4, it can be seen that a number of pairs of disc halves are mounted to axle 22. The spacing between a pair of disc halves (for instance, see reference numeral 25 in FIG. 4), also corresponds to the diameter of a golf ball such that a golf ball can be picked up between adjacent pairs of disc halves as well as between each disc half. The sets of bolted together pair of disc halves are each rotatable about axle 22. That is, the discs are not fixed to the axle. This allows each set of discs to rotate at different speeds, such as when a unit is turned. Dislodging fingers 26 extend between the disc halves, and adjacent pairs of discs to dislodge golf balls which are picked up by the discs. The golf balls ride over dislodging fingers 26 and into a respective basket 19, 20. The arrangement of providing dislodging fingers is known and is described in my earlier U.S. Pat. No. 5,141,383 and my earlier International Patent Application No. PCT/AU94/00757.

In use, the golf ball collecting units pass over a ground surface. When the unit passes over a golf ball, the golf ball is trapped either between disc halves 23, 24 or in spacing 25 and are then moved to dislodging fingers 26 upon rotation of the discs as the discs roll along the grounds surface. The dislodging fingers will dislodge the golf balls and pass them into collection baskets 19, 20.

Figure 1:
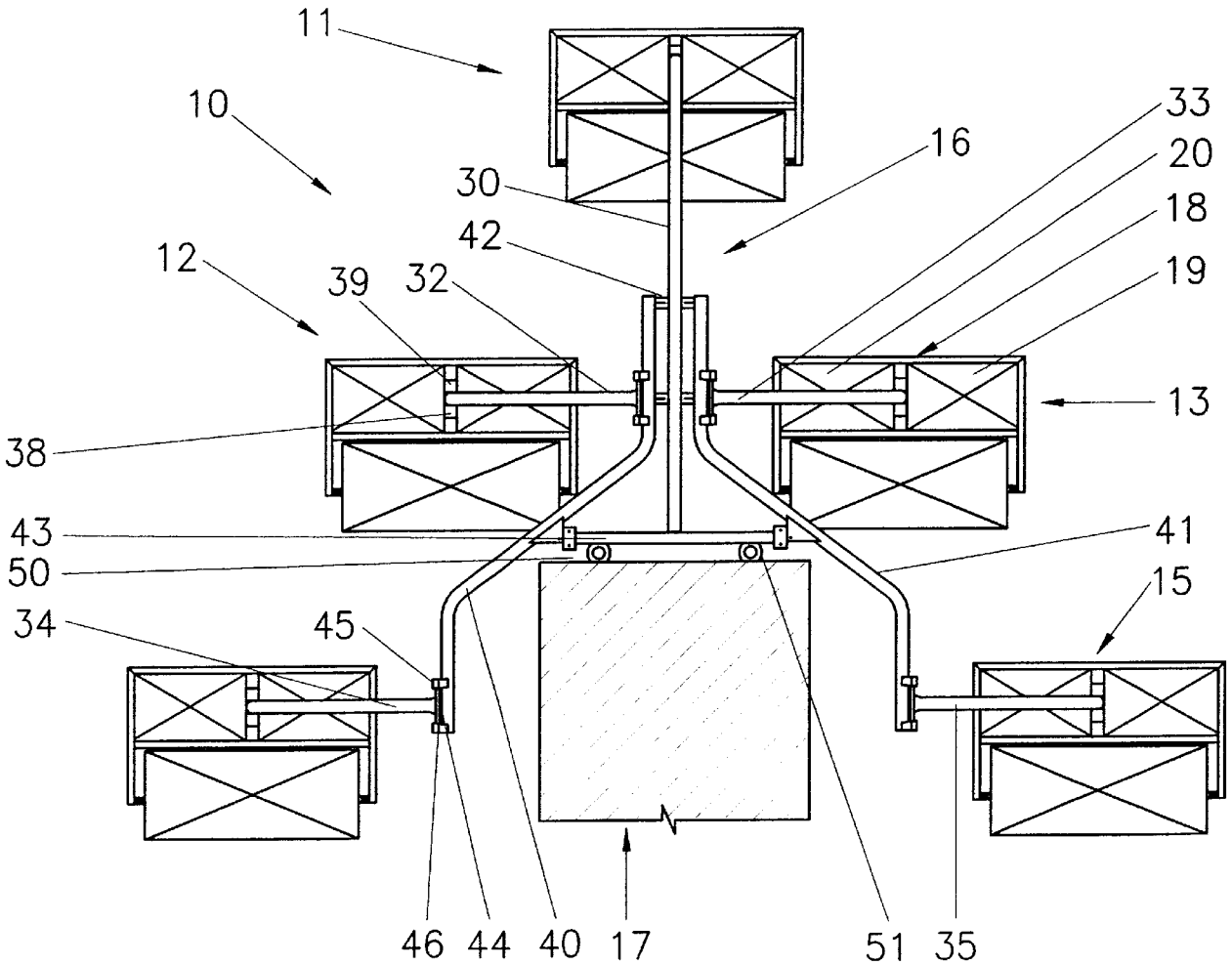
FIG. 1 is a plan view of a golf ball retrieving apparatus according to an embodiment of the invention.

The other golf ball collecting units illustrated in FIG. 1 are similar to that described above and illustrated with reference to FIG. 4.

Figure 2:
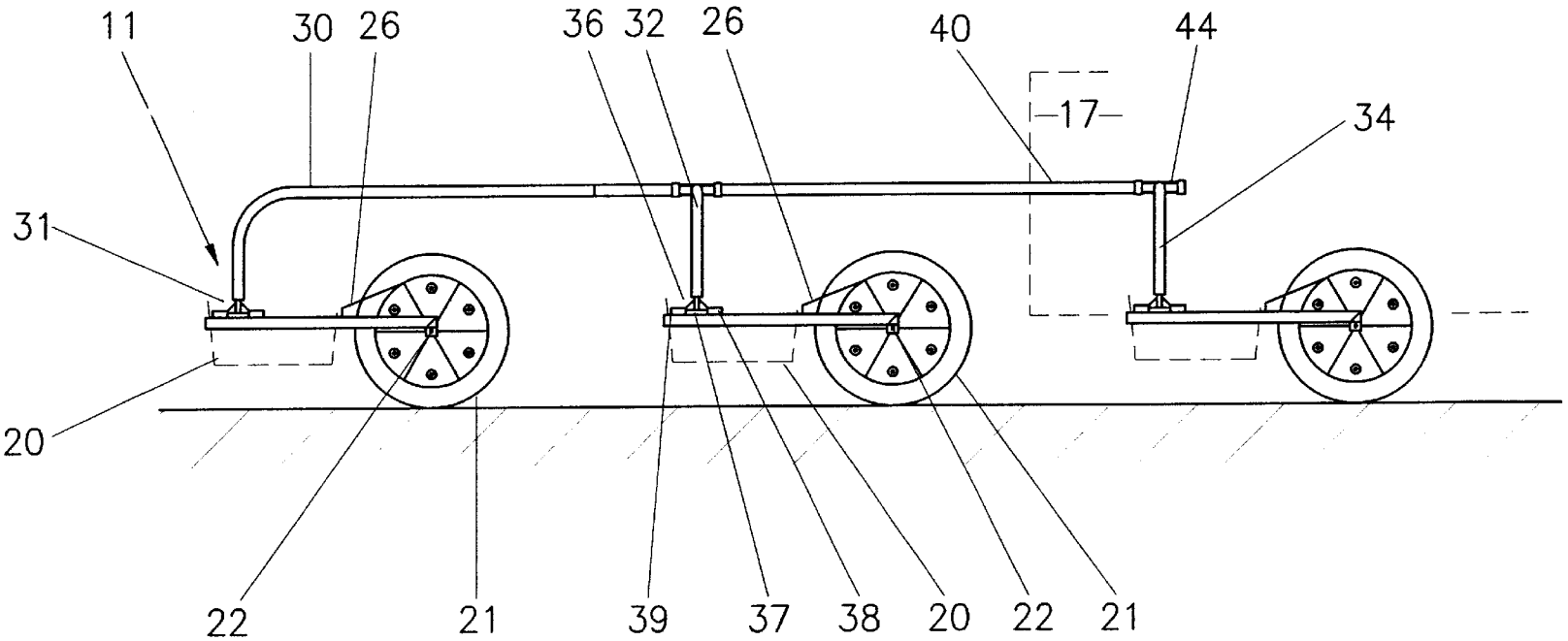
FIG. 2 is a side view of the retrieving apparatus of FIG. 1.

Referring to FIG. 1, and also to FIG. 2, first golf ball collecting unit 11 is swivably attached to main frame assembly 16, and more particularly, is swivably attached to a rigid first frame member 30. First frame member 30, in the embodiment, comprises a tubular steel member which extends forwardly of pushing vehicle 17. Frame member 30 curves downwardly adjacent its forward portion (see FIG. 2) and couples to first golf ball collecting unit 11. The coupling is a swiveltype coupling 31 which allows the unit to swivel or pivot about a substantially vertical axis. This assists in easy turning of the golf ball retrieving apparatus.

Golf ball collecting units 12–15 are not directly coupled to main frame assembly 16, but instead are swivably coupled to respective arm members 32–35, the arm members being formed from rigid steel tubing. Arm members 32–35 curve downwardly adjacent their free ends and swivably couple to their respective golf ball collecting units 12–15 in a manner similar to that described above with reference to unit 11. Thus, each of golf ball collecting units 11–15 is swivably coupled relative to main frame assembly 16.

Golf ball collecting units 11–15, as well as being swivably coupled to their respective arm members to enable them to swivel or pivot about a substantially vertical axis, are also pivotally coupled relative to the respective arm members to allow each unit to rock up and down, or in another manner of speaking to pivot about a substantially horizontal axis which is in line with the direction of travel of the retrieving apparatus. For instance, referring to retrieving unit 12, and referring to FIG. 2, it can be seen that swivel coupling 36 includes a horizontal shaft member 37 which extends into two bearing blocks 38, 39 to allow unit 12 to pivot about shaft member 37. Retrieving units 11, 13–15 have identical or similar shaft members and bearing blocks to enable each of these units to also pivot or rock from side to side.

Main frame assembly 16 is formed from first frame member 30 and second and third frame members 40, 41 which are coupled to first frame member 30 approximately mid-way therealong and extend rearwardly of first frame member 30, to each side of pushing vehicle 17 and terminate rearwardly from a forward portion of pushing vehicle 17. Second and third frame members are rigidly attached to first frame member 30 such that the main frame assembly 16 comprises first frame member 30 and second and third frame members 40 and 41. Second and third frame members 40 and 41 can be bolted to the first frame member 30 through bolts 42, so that these frame members can be removed from frame member 30 for ease of storage and transportation. A reinforcing strut 43 made of steel box-section extends between frame members 40 and 41 and also couples to the end of frame member 30 to form a rigid frame assembly.

The arm members of golf ball collecting units 12–15 are pivotally coupled to either of frame members 40, 41 to enable the arm members to move up and down about a substantially horizontal pivot axis. For instance, referring to collecting unit 14, its arm member 34 is pivotally coupled to second frame member 40 through a shaft 44 extending into bearing blocks 45, 46, the bearing blocks being attached to second frame member 40. Collecting units 12–15 are pivotally attached in a similar manner to either second frame member 40 or third frame member 41.

The entire apparatus 10 is coupled to pushing vehicle 17 through ball and socket joints 50, 51 to allow the entire apparatus to pivot up and down relative to pushing vehicle 17.

Figure 3:
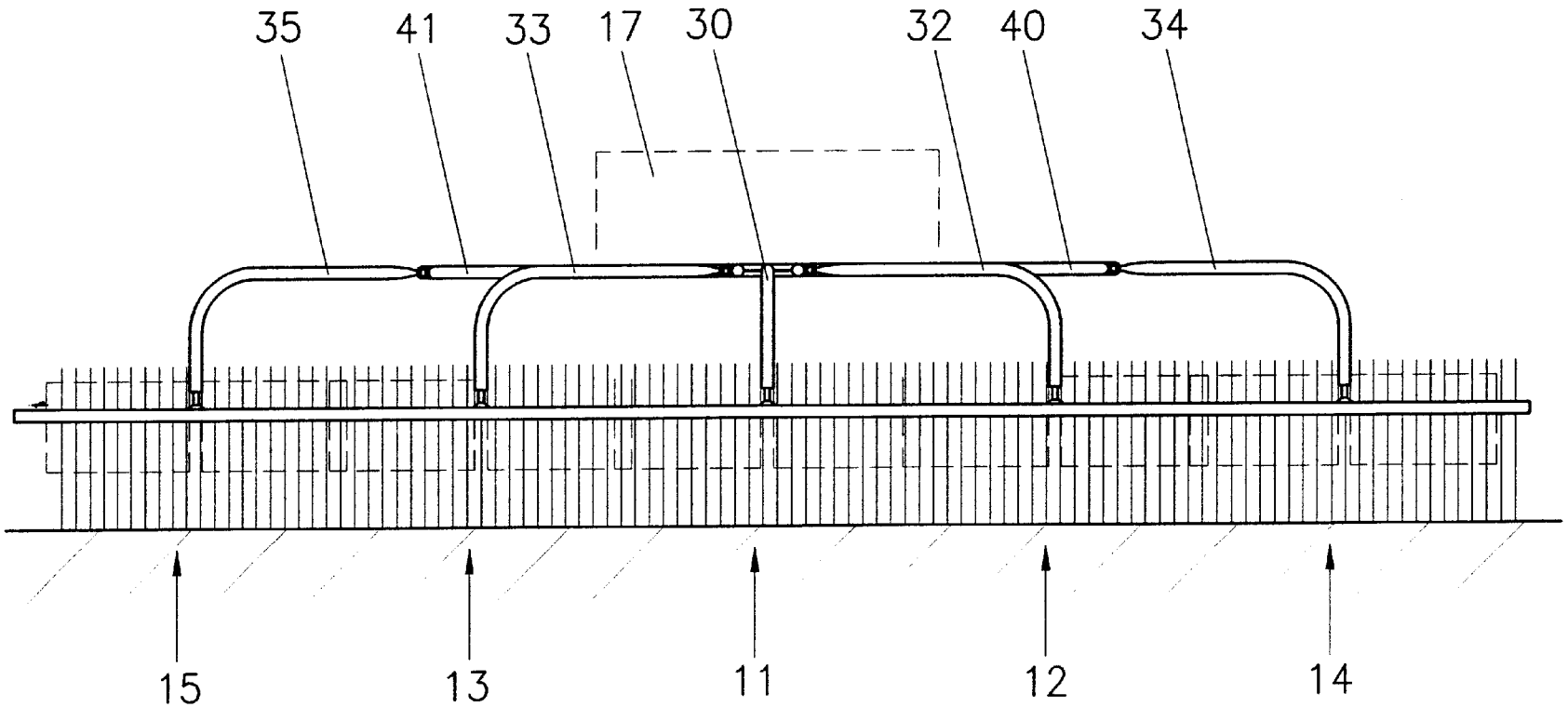
FIG. 3 is a front view of the retrieving apparatus of FIG. 1.

FIG. 3 shows a front view of the entire apparatus and it can be seen that the various golf ball collecting units although being separate and not coupled to each other form an array which will collect all golf balls as the apparatus is pushed along a fairway.

It can be seen that the apparatus of the invention is simple and robust in design. Each golf ball collecting unit can swivel and can also rock and pivot about various axis to allow the units to track undulations along a grounds surface.

It should be appreciated that various other changes and modifications may be made to the embodiment described without departing from the spirit and scope of the invention.

What is claimed is:

1. A golf ball retrieving apparatus adapted to be pushed forward of a pushing vehicle, the apparatus comprising a plurality of golf ball collecting units coupled to a main frame assembly;

each of the golf ball collecting units having a plurality of discs comprising pairs of spaced apart disc halves which are attached together in such a manner that the disk halves of each pair are unable to rotate relative to each other;

the spacing between the disc halves corresponding to the diameter of a golf ball whereby a golf ball can be picked up between disc halves;

the disc halves being mounted to a common axle;

the spacing between pairs of disc halves corresponding to the diameter of a golf ball such that a golf ball can be picked up between adjacent pairs of disc halves as well as between each pair of disc halves; and the disc halves being rotatable about the common axle and adjacent discs rotate relative to each other at different speeds when a unit is turned.

2. A golf ball retrieving apparatus adapted to be pushed forward of a pushing vehicle, the apparatus comprising a golf ball collecting unit coupled to a main frame assembly;

the golf ball collecting unit having a plurality of discs comprising pairs of spaced apart disc halves which are attached together in such a manner that the disk halves in each pair are unable to rotate relative to each other;

the spacing between the disc halves corresponding to the diameter of a golf ball whereby a golf ball can be picked up between disc halves;

the disc halves mounted to a common axle;

the spacing between pairs of disc halves corresponding to the diameter of a golf ball such that a golf ball can be picked up between adjacent pairs of disc halves as well as between each pair of disc halves; and the disc halves being rotatable about the common axle and adjacent discs rotate relative to each other at different speeds when a unit is turned.

* * * * *